United States Patent [19]

Watson

[11] Patent Number: 4,698,039

[45] Date of Patent: Oct. 6, 1987

[54] APPARATUS FOR WALKING ON WATER OR LAND

[76] Inventor: Benjamin H. Watson, 2601 NE. 4th St., #622, Renton, Wash. 98056

[21] Appl. No.: 922,674

[22] Filed: Oct. 24, 1986

[51] Int. Cl.[4] ..... A63C 9/32

[52] U.S. Cl. ..... 441/77

[58] Field of Search ..... 441/65, 76, 77, 78, 441/79

[56] References Cited

U.S. PATENT DOCUMENTS

| | | | |
|---|---|---|---|
| 3,758,898 | 9/1973 | Dougherty | 441/77 |
| 3,777,324 | 12/1973 | Jenkins | 441/77 |
| 3,936,897 | 2/1976 | Schaumann | 441/77 |

*Primary Examiner*—Jeffrey V. Nase
*Assistant Examiner*—Jesûs D. Sotelo
*Attorney, Agent, or Firm*—Robert W. Jenny

[57] ABSTRACT

The subject apparatus comprises a pair of floats, each having propulsion apparatus attached to its bottom. There is a foot well in each float, extending from top to bottom and fitted with toe retaining and heel support elements. The propulsion apparatus comprises an I-beam having a top flange, web and bottom flange and pairs of flaps hinged to the web, one of each pair on each side of the web. The pairs are spaced equidistant from each other along the web. The hinge axes are vertical. Each flap hinges between the closed position (against the web) to the open position (about 90° to the web). The longitudinal axis of the I-beam is parallel to the longitudinal axis of the float to which it is attached and the web functions as a keel. The bottom flange is angled slightly upward toward the front end. The midpoints of the lengths of the foot wells and propulsion apparatus are somewhat aft of the lengthwise midpoints of the floats. The propulsion apparatus is about half as long as the float.

2 Claims, 9 Drawing Figures

FIG. 4A
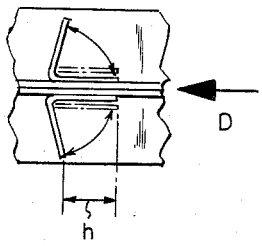
FIG. 4B
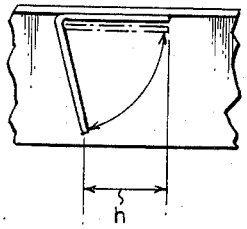
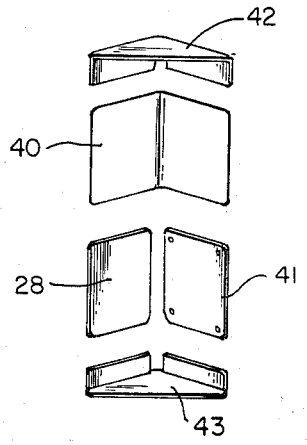
FIG. 5A
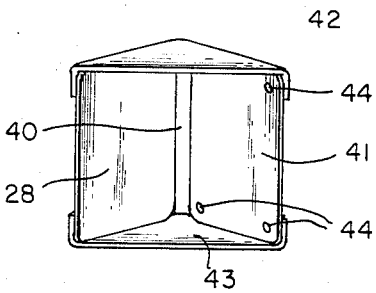
FIG. 5B
FIG. 6
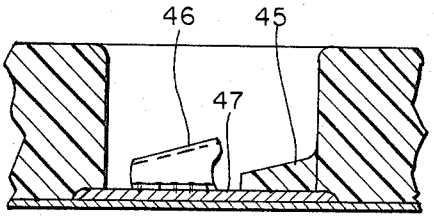

APPARATUS FOR WALKING ON WATER OR LAND

BACKGROUND OF THE INVENTION

1. Field:

The subject apparatus is in the field of water sports equipment, more specifically equipment which enables the user to be supported in an erect postion and self-propelled on water or land. More specifically, it is in the field of such equipment comprising a pair of elongated floats adapted to fit on the feet of the user with propulsion accomplished by walking or striding motion.

2. Prior Art:

There is profuse prior art for this invention, even in the specific field, some of the most pertinent described in U.S. Pat. Nos.: 3,601,828, 3,716,881, 3,758,898, 3,777,324, 4,037,280, and French Pat. No. 78 09169 and German Pat. No. 3342365.

It is clear from the prior art that there is a longstanding desire, if not need, for the subject type of apparatus. It is also clear that none of the prior art has achieved significant commercial success. It is believed that the lack of commercial success can be attributed to two significant factors, among others. First, the propulsion efficiency has been such that considerable endurance and athletic ability have been required to achieve satisfactory performance. Second, the various apparatuses have been subject to damage during ordinary usage, particularly the propulsion apparatus.

In regard to propulsion efficiency, propulsion on water is provided by flaps arranged such that when a float is moved forward, the flaps hinged to it fold against a surface parallel to the direction of motion and resistance to motion forward is reduced. When the float is moved in the aft direction, the flaps hinge outward to engage a volume of water and the acceleration of this water in the aft direction provides the desired propulsion force. For good efficiency, the flaps should hinge outward (fold open) in response to as little aftwise float motion as possible to engage the volume of water. Any aft motion before the flaps open and during the opening is lost motion, resulting in lower propulsion efficiency.

Also, the flaps should be fully submerged, regardless of the weight of the user and the corresponding amount of submersion of the floats to support the weight. Further, the flap working area should be as large as practical.

In the prior art apparatuses, some use propulsion flaps or equivalent on the sides of the floats. These flaps are not fully submerged. On some apparatuses the flaps are hinged to the bottoms of the floats. However, if flap area is approximately equal to the crossectional area of a float (i.e. each flap is square and as wide as a float), the lost motion to open the flaps is excessive. To explain, with the dimension of the flap edge hinged to the float denoted as the span, the dimension of the flap from the hinged edge to the opposite edge denoted as the chord and the flap square as described, the chord equals the span. The aft motion required to open the flap is approximately equal to the chord since the edge away from the hinged edge must move from essentially directly aft of the hinged edge to essentially directly below it. With the span equal to the chord, the lost motion is about equal to the width of the float and experience has shown that to be excessive.

Further, flaps mounted on the float bottom are fulnerable to damage if and when submerged objects are encountered or there is insufficient water depth for the necessary flotation.

In view of the above, it can be understood that a first objective of the subject invention is provision of propulsion apparatus having effective flap areas as large as 80% of the float crossectional area but with lost motion required to open the flap considerably less than the effective span. A second objective is that the propulsion flaps be mounted below the floats so that they are always fully submerged regardless of the weight of the user. A third objective is that the flaps not be vulnerable to damage from submerged objects and from use in shallow water or on land or other walk-on surfaces.

SUMMARY OF THE INVENTION

The subject invention comprises a pair of elongated floats having tops, sides, bottoms and fore and aft ends. The floats are shaped according to principles well known in the art to reduce their resistance to motion along the surface of water in the forward direction. Portions of the bottoms are flat and propulsion apparatus is attached to the flat portions. A foot well is set into the top of each float and extends downward to the bottom of the float. The wells are positioned centrally in the floats in the width and somewhat aft of the midpoints between fore and aft ends. Equipment is provided for positioning, supporting and retaining each foot inserted in each well.

The floats are sized such that they will support people in the weight range of 100 to 250 pounds with no more than two-thirds their volume being submerged to support the 250 pounds.

Propulsion apparatus comprises an I beam having a top flange, bottom flange and a web interconnecting the flanges. The I beam is symmetrical to the plane of the web. The width of the I beam (i.e. the width of the flanges) is in the range of 80 to 90 percent of the width of a float and the height (i.e. distance between flanges) is in the range of 70 to 90 percent of the width. The flanges may be parallel. However, in a preferred embodiment the bottom flange is closer to the top flange at the forward end, the angle between the flanges being in the range of 1 to 10 degrees.

Flaps are hinged to the web in symmetrical pairs. The axes of the hinge apparatuses are perpendicular to the top flange and close to the web. Each flap is essentially flat and rectangular in plan form and has a span and a chord dimension. The span dimension is parallel to the hinge axis and the chord dimension is perpendicular to it. The span dimension is in the range of 80 to 95 percent of the height of the I beam and the cord dimension is in the range of 40 to 50 percent of the width of the I beam.

The flap pairs are located equidistant from each other along the web. The forwardmost pair is located with the hinge lines near the forward end of the web. The aftmost pair is located so that the flap edges opposite the hinge edges are close to the aft end of the web. The number of pairs used is a design compromise. Four pairs are considered optimum.

The length of the I beam is in the range of 35 to 55 percent of the length of a float. The I beam is attached to the flat portion of the bottom of the float positioned symmetrical with the float widthwise and positioned with the percentage of its length forward of the footwell in the range of 50 to 70 percent.

The hinge apparatus for each flap allows the flap to move from a position in which the chord dimension is parallel to the web to a position in which it is at an angle to the web in the range of 80 to 90 degrees. A preferred hinge apparatus is made of fabric with the fabric functioning as the hinge and webs of fabric at each end of the flap serving to limit flap motion and to trap water in the cavity formed by the flap and the webs at each of its ends.

In typical use the floats are placed parallel and close to each other on the ground. The user inserts one foot into each of the wells, engaging the support, positioning and retaining apparatus. The user and floats are supported on the lower flanges and the user "walks" the floats into the water. Once afloat, propulsion is achieved by moving the floats alternately forward and aft. The webs of the I beams function as keels, significantly helping in directional control and stability and in limiting the tendency of the floats to move sidewise.

It can be understood from this summary that the invention meets its objectives. Effective flap area can be as large as 80 percent of the crossectional area of a float. The lost motion needed to open the flaps on a propulsion is considerably less than the effective span. The flaps are always fully submerged when the apparatus is in use on water and the flaps are not vulnerable to damage from underwater objects or from use in shallow water or on land or other walk-on surfaces.

BRIEF DESCRIPTION OF THE DRAWINGS

FIGS. 4*a* and FIG. 4*b* are schematic diagrams illustrating a comparison of the operation of paired flaps and a single flap of equivalent working area.

FIG. 5*a* illustrates an exploded view of a preferred flap hinge embodiment.

FIG. 5*b* is a view of the assembled hinged flap assembly.

FIG. 6 is a sectional view of a float taken at 6—6 in FIG. 1.

DETAILED DESCRIPTION OF THE INVENTION

Figure 1:
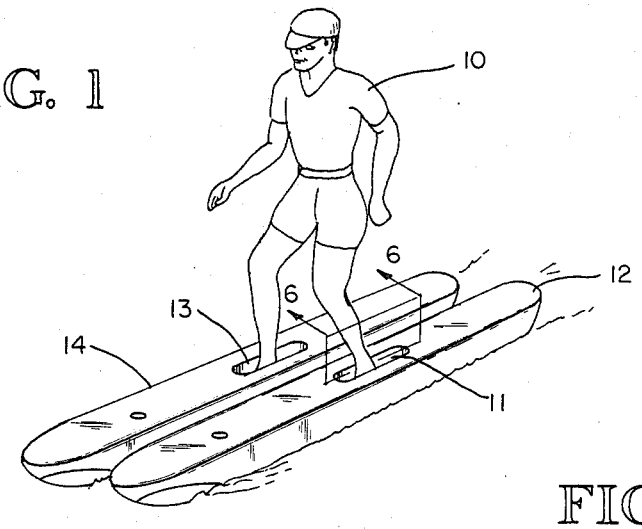
FIG. 1 is a perspective view of the subject invention in use on water.
Figure 2:
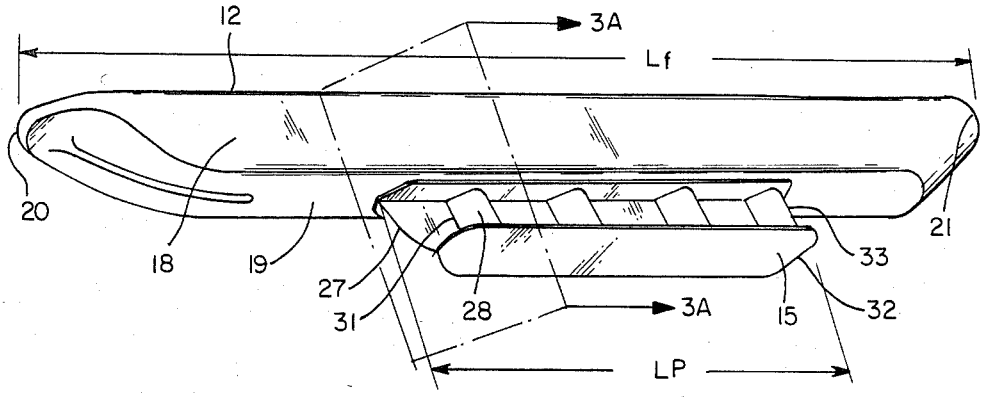
FIG. 2 is a perspective view of one of the floats with propulsion apparatus attached.

Referring to FIG. 1, user 10 has one foot in well 11 of float 12 and the other in well 13 of float 14. The floats are identical and float 12 is shown in FIG. 2 with propulsion apparatus 15 attached. The float has a top 16, sides 17 and 18 (see FIG. 3), bottom 19, forward end 20 and aft end 21. The float is symmetrical with its longitudinal axis in the plane of symmetry. Bottom 19 is flat over a portion of the length of the float and propulsion apparatus 15 is attached to the flat portion of the bottom. The propulsion apparatus comprises I beam 23 which further comprises top flange 24, bottom flange 25 and web 26 interconnecting flange 24 and 25. The beam may be an extrusion or built up with sheet metal parts. The apparatus is symmetrical about the web and its longitudinal axis which lies in the web. Flanges 24 and 25 may be parallel; however, in a preferred embodiment flange 25 is closer to flange 24 at the forward end 27 of the I beam. The angle between the flanges is in the range of 1 to 10 degrees. Flaps, of which flap 28 is typical, are hinged to web 26 in pairs, one of each pair on each of sides 29 and 30 of the web. The hinge axes of the flaps, of which axis 31 is typical, are equidistantly spaced along the web with the hinges of the forwardmost pair near end 27 of the beam and the trailing edges of the pair nearest end 32 of the beam, edge 33 being a typical trailing edge, just forward of end 32 when the flaps are hinged against the web.

Each flap is essentially rectangular and has a hinge edge 34, a trailing edge 33, a top edge 35 and a bottom edge 36. The distance between the hinge and trailing edge is denoted the chord of the flap.

Figure 3A:
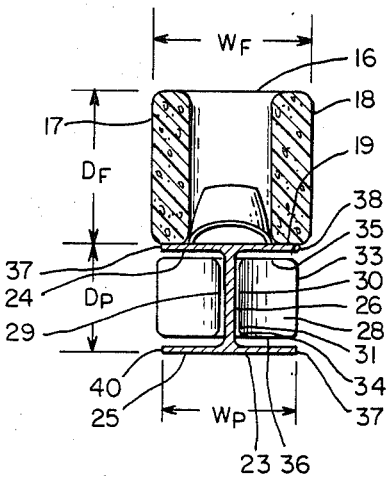
FIG. 3*a* is a sectional view taken at 3*a*—3*a* in FIG. 2.

Referring to FIG. 3*a*, a crossectional view of a float and propulsion apparatus taken at 3*a*—3*a* in FIG. 2, float width is designated $W_f$ and float depth $D_f$. The float crossection is essentially rectangular and its crossectional area is designated $A_f = W_f \times D_f$. The crossectional area of the propulsion apparatus is designated $A_p = W_p \times D_p$.

The chord and span dimensions of the flaps are such that when the flaps are hinged to their open position, that is, at an angle of 80° to 90° with the web, they virtually fill the crossectional area on each side of the web between the flanges. The trailing edges lie in or close to planes intersected by the edges 37 and 38 of the top and bottom flanges respectively on one side and edges 39 and 40 on the other. The top edges of the flaps are close to the top flange and the bottom edges close to the bottom flange.

With this crossectional configuration, it is practical for the crossectional area of the propulsion apparatus to be a large percentage of the crossectional area of the float, as high as 80 percent, for example. It has been determined that a percentage of 60 percent provides a good design compromise, providing a good propulsion efficiency. The propulsion efficiency is further enhanced by the fact that the paired flaps go from their closed position (hinged against the web) to their open position with less lost motion than would be required with a single flap which presents equivalent crossectional area when open. This area is termed the working surface or working area. Referring to FIGS. 4*a* and 4*b*, FIG. 4*a* is a diagrammatic end view of a pair of flaps, the solid lines representing the flaps open and the phantom lines representing the flaps closed. FIG. 4*b* is a diagrammatic end view of a single flap with the solid lines representing it in the open position and the phantom lines the closed position. These views show the "chords" of the flaps. For purposes of this explanation all the flaps have the same span. The chord of the single flap is twice that of the paired flaps, so that the working area is the same in each case. The dimension h in each case represents the distance the trailing edge of the flap(s) moves in the direction D (the fore and aft direction of float motion) as the flap opens. It can be seen that the distance for the paired flaps is half that required for a single flap of equivalent working area.

Referring again to FIG. 2, the length of the float is designated $L_f$. The length of the propulsion apparatus is designated $L_p$. $L_p$ is a percentage of $L_f$, the percentage being in the range of 35 to 60 percent. The propulsion apparatus is positioned so that more of its length is forward of the foot well than aft of it. Fifty-five to sixty percent of the propulsion apparatus is forward of the foot well.

The foot well is located so that the midpoint of the length of a foot positioned in the well is 55 plus or minus 5 percent of the distance from the forward end of the float to the aft end. This location aft of the midpoint of the float, plus the upward slope of the lower flange help to cause the forward ends of each float to lift somewhat when the float is moved forward in the water.

The flaps may be hinged to the web by any suitable means conceivable by persons skilled in the art, along with means for limiting the motion of the flaps to open positions at angles of 80° to 90° with the web. However, FIG. 5, 5*a* and 5*b* illustrates a preferred hinging and motion limiting embodiment. The embodiment comprises flap 28, a fabric hinge 40, a hinge plate 41, and fabric motion limiters 42 and 43 known as webs. (The flaps are often commonly called flippers.) The hinge plate, flap, fabric hinge and webs are assembled using adhesives well known to those skilled in the art. The assembly is attached to the web by threaded fasteners or equivalents in holes 44 in the hinge plate. One set of fasteners is used to hold each pair of flaps to the web.

Referring to FIG. 6, a sectional view of a foot well, taken in the plane of symmetry of a float, at the bottom of the foot well there is a heel pad 45 and a toe binder 46. The heel pad 45 is a resilent truncated wedge with its butt against the aft wall of the web and its forward end approximately at the fore and aft midpoint of the bottom of the well. The angle between the top and bottom surfaces of the wedge is in the range of 15° to 30°. The toe binder 46, mounted in the forward half of the bottom of the well, is of the type used on water skis and the like to hold the ski to the user's foot and well known in the art. Board 47 reinforces the bottom of the foot well and is adhesively bonded in place.

Figure 3B:
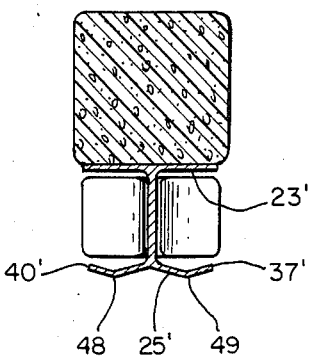
FIG. 3*b* is a sectional view showing an alternate I beam configuration.

FIG. 3*b* is a crossectional view of a float with propulsion apparatus attached, showing an alternate configuration of I beam 23'. In this configuration the lower flange 25' is angled downward on each side of its longitudinal centerline, the angles being in the range of 5 to 10 degrees out of horizontal. About two-thirds of the distances from the center line to edges 37' and 40', the flange angles upward, also at angles in the range of 5 to 10 degrees out of horizontal. The result is that ridges of 48 and 49 are formed and serve as the contacts with the ground when the apparatus is used out of water, providing better stability than is provided by the flat lower flange.

It can be understood from this description that the subject invention meets its objectives. The effective area of each pair of flaps, when open for propulsive action, can be as large as 80 percent of the crossectional area of a float transverse to the longitudinal center plane of the float. The lost motion on a propulsion stroke to open the flaps is considerably less than the effective span of the working area of the flaps, thus increasing propulsive efficiency. The flaps are always fully submerged when the apparatus is in use on water, regardless of the weight of the user. The flaps are protected from damage by contacts with underwater objects or the bottom surface of the body of water.

A preferred embodiment of the subject invention is described herein. However, it will be understood that other embodiments and variations of the one described are possible within the scope of the invention which is limited only by the scope of the appended claims.

What is claimed is:

1. Apparatus for walking on water or land, comprising two essentially identical assemblies, each assembly comprising:

a float and a propulsion apparatus, said floating having:

a top, a bottom having a flat portion, a first longitudinal axis, a first length, a first forward end, a first aft end, and a footwell set into said top and extending to said bottom, said footwell located symmetrically relative to said first longitudinal axis and having a forward end located at a distance in the range of 50% to 60% of said first length from said first forward end, said propulsion apparatus comprising:

an I beam, a plurality of flaps and a plurality of hinge apparatuses, one for each of said flaps of said plurality of flaps, each of said hinge apparatuses having a deflection limiting means and an effective hinge axis, said I beam having:

a top flange, a bottom flange, said top and bottom flanges being parallel to each other, a web having a first side and a second side, a second length, a second forward end, a second aft end, and a second longitudinal axis, said second length being in the range of 35% to 60% of said first length, said flanges having first and second edges parallel to said longitudinal axis, said web joining said flanges midway between said first and second edges, each of said flaps of said plurality of flaps being essentially rectangular and having a top edge, a bottom edge, a hinge edge, an outer edge, a working surface, and a width between said hinge edge and said outer edge, each of said flaps being hinged to said web by one of said hinge apparatuses with said effective hinge axis essentially perpendicular to said second longitudinal axis, half of said plurality on said first side, half on said second side, with said hinge edge close to one of said sides, said top edge close to said top flange, said bottom edge close to said bottom flange, said width of each said flaps being such that when said flaps are deflected away from said sides to the extent permitted by said deflection limiting means said outer edges lie essentially in a a first plane intersected by said first edges of said flanges and a second plane intersected by said second edges of said flanges and said working surfaces are at an acute angle to said sides, said angle being in the range of 80° to 89°, said flaps being positioned equidistant from each other in two series, one series on each of said sides, along said second length, the first in each of said two series having said hinge edges near said second forward end and the last in each of said two series having said outer edges at said second aft end when said flaps are hinged to positions in which said working surfaces are close to and essentially parallel to said sides, said top flange being fastened to said flat portion of said bottom with said first and second longitudinal axes essentially parallel and said second forward end positioned a distance X from said first forward end, said distance X being in the range of 20 to 30 percent of said first length.

2. Apparatus for walking on water or land, comprising two essentially identical assemblies, each assembly comprising:

a float and a propulsion apparatus, said float having:

a top, a bottom having a flat portion, a first longitudinal axis, a first length, a first forward end, a first aft end, and a footwell set into said top and extending to said bottom, said footwell located symmetrically relative to said first longitudinal axis and having a forward end located at a distance in the range of 50% to 60% of said first length from said first forward end, said propulsion apparatus comprising:

an I beam, a plurality of flaps and a plurality of hinge apparatuses, one for each of said flaps of said plurality of flaps, each of said hinge apparatuses having a deflection limiting means and an effective hinge axis, said I beam having:

a top flange, a bottom flange, a web having a first side and a second side, a second length, a second forward end, a second aft end, and a second longitudinal axis, said second length being in the range of 35% to 60% of said first length, said flanges having first and second edges parallel to said longitudinal axis, said web joining said flanges midway between said first and second edges said bottom flange being at an angle to said top flange, said angle being in the range of 1° to 10°, said bottom flange being closer to said top flange at said second forward end than at said second aft end, each of said flaps of said plurality of flaps being essentially rectangular and having a top edge, a bottom edge, a hinge edge, an outer edge, a working surface, and a width between said hinge edge and said outer edge, each of said flaps being hinged to said web by one of said hinge apparatuses with said effective hinge axis essentially perpendicular to said second longitudinal axis, half of said plurality on said first side, half on said second side, with said hinge edge close to one of said sides, said top edge close to said top flange, said bottom edge close to said bottom flange, said width of each said flaps being such that when said flaps are deflected away from said sides to the extent permitted by said deflection limiting means said outer edges lie essentially in a first plane intersected by said first edges of said flanges and a second plane intersected by said second edges of said flanges and said working surfaces are at an acute angle to said sides, said angle being in the range of 80° to 89°, said flaps being positioned equidistant from each other in two series, one series on each of said sides, along said second length, the first in each of said two series having said hinge edges near said second forward end and the last in each of said two series having said outer edges at said second aft end when said flaps are hinged to positions in which said working surfaces are close to and essentially parallel to said sides, said top flange being fastened to said flat portion of said bottom with said first and second longitudinal axes essentially parallel and said second forward end positioned a distance X from said first forward end, said distance X being in the range of 20 to 30 percent of said first length.

* * * * *